US006644401B1

(12) United States Patent
Miller

(10) Patent No.: US 6,644,401 B1
(45) Date of Patent: Nov. 11, 2003

(54) SLIP TYPE CASING HANGER WITH INTEGRAL HIGH PRESSURE ISOLATION PLATE

(75) Inventor: Michael J. Miller, Katy, TX (US)

(73) Assignee: Kvaerner Oilfield Products, Inc., Houston, TX (US)

( * ) Notice: Subject to any disclaimer, the term of this patent is extended or adjusted under 35 U.S.C. 154(b) by 89 days.

(21) Appl. No.: 10/050,721

(22) Filed: Oct. 26, 2001

(51) Int. Cl.[7] ..... E21B 33/04

(52) U.S. Cl. ..... 166/75.14; 166/88.2; 285/123.6; 285/123.13

(58) Field of Search ..... 166/75.14, 88.2; 285/123.7, 123.8, 123.14, 123.13

(56) References Cited

U.S. PATENT DOCUMENTS

| | | | | | |
|---|---|---|---|---|---|
| 2,315,134 | A | * | 3/1943 | Roach et al. | 285/123.7 |
| 2,824,757 | A | * | 2/1958 | Rhodes | 285/123.8 |
| 2,887,754 | A | * | 5/1959 | Johnson | 188/67 |
| 3,438,654 | A | * | 4/1969 | Jackson, Jr. et al. | 285/123.7 |
| 4,646,827 | A | * | 3/1987 | Cobb | 166/88.2 |
| 4,790,379 | A | * | 12/1988 | Vanderford, Jr. | 166/208 |
| 5,342,066 | A | | 8/1994 | Henley | 277/116.2 |
| 6,015,009 | A | | 1/2000 | Allen | 166/89.3 |
| 6,035,938 | A | | 3/2000 | Watkins | 166/345 |
| 6,095,242 | A | | 8/2000 | Lequang | 166/88.2 |
| 6,138,751 | A | | 10/2000 | Hart | 166/75.14 |
| 2003/0042027 | A1 | * | 3/2003 | Lang et al. | 166/382 |

* cited by examiner

*Primary Examiner*—Hoang Dang
(74) *Attorney, Agent, or Firm*—Wendy Buskop; Buskop Law Group, P.C.

(57) ABSTRACT

The invention relates to a slip type casing hanger assembly, having a hanger body with an annulus, a casing head disposed around casing for supporting and transferring weight of the casing string to the casing head. The slip type casing hanger assembly further includes (a) an adjustable isolation plate for sealing the annulus, further including a lower plate landing on a load shoulder, an upper plate adjoining the annulus, and a spacer separating the lower plate from the upper plates; (b) a plurality of fasteners for securing the spacer to the upper plate and the lower plate; (c) at least two slip segments, each comprising a plurality of teeth for engaging and suspend the casing string, with each slip segment having a top step and bottom step for engaging the hanger body; (d) at least one alignment ring for aligning the slip segments, and (e) locking apparatus for securing the isolation plate against the load shoulder.

19 Claims, 3 Drawing Sheets

SLIP TYPE CASING HANGER WITH INTEGRAL HIGH PRESSURE ISOLATION PLATE

BACKGROUND OF THE INVENTION

This invention relates to oil and gas wells, particularly surface wells. In particular, the invention relates to a casing string provided in land and offshore petroleum production installations for suspension of casing and for providing a barrier and a fluid conduit between the casing strings.

Slip type casing hangers have been taught in numerous patents of which U.S. Pat. Nos. 6,095,242 and 5,342,066 are incorporated by reference. Also of note are related inventions of U.S. Pat. Nos. 6,138,751, 6,035,938 and 6,015,009. None of the known art has taught an assembly, which provides significant load handling. The present invention, with novel isolation plat and spacer configuration provides an increase of 34–40% in the ability to sustain and transfer load.

OBJECTIVES OF THE INVENTION

A primary objective of the invention is to increase the load capability of the casing hanger by 30 to 40%.

A secondary objective of the invention is to provide a casing hanger assembly, which is adjustable in the field for ease of maintenance without requiring the pulling of the entire assembly, particularly to adjust between the minimum and maximum tolerances of the casing.

Another object of the invention is to provide a means to easily replace packing by utilizing a mechanism that can be readily energized with locking screws, without pulling the entire assembly.

SUMMARY OF THE INVENTION

The invention relates to a slip type casing hanger assembly, having a hanger body with an annulus, a casing head disposed around casing for supporting and transferring weight of the casing string to the casing head comprising: (a) an adjustable isolation plate for sealing the annulus, further comprising a lower plate landing on a load shoulder, an upper plate adjoining the annulus, and a spacer separating the lower plate from the upper plates; (b) a plurality of fasteners for securing the spacer to the upper plate and the lower plate; (c) at least two slip segments, each comprising a plurality of teeth for engaging and suspend the casing string, with each slip segment having a top step and bottom step for engaging the hanger body; (d) at least one alignment ring for aligning the slip segments, and (e) locking means for securing the isolation plate against the load shoulder.

DETAILED DESCRIPTION OF THE PREFFERED EMBODIMENTS

The invention is directed to an improvement for surface wells having a casing string with a casing hanger. The invention is a slip type casing hanger assembly, having a hanger body with an annulus, a casing head disposed around the casing for supporting and transferring weight of the casing string to the casing head which comprises: an adjustable isolation plate for sealing the annulus.

The isolation plate is made from a lower plate landing on a load shoulder, an upper plate adjoining the annulus separated by a spacer. At least two and up to 16, 20 or 24 fasteners can be used to attached the spacer between the upper plate and the lower plate. Two slip segments, each having at least one top step and at least one bottom step, fabricated in a tapered construction are used adjacent the isolation plate. Each step has teeth for engaging and suspending the casing string. In an alternative embodiment, more than two slip segments can be used, with each slip segment having a top step and bottom step for engaging the hanger body. At least one alignment ring is contemplated for aligning the slip segments. Locking screws are used for securing the isolation plate against the load shoulder.

Figure 1:
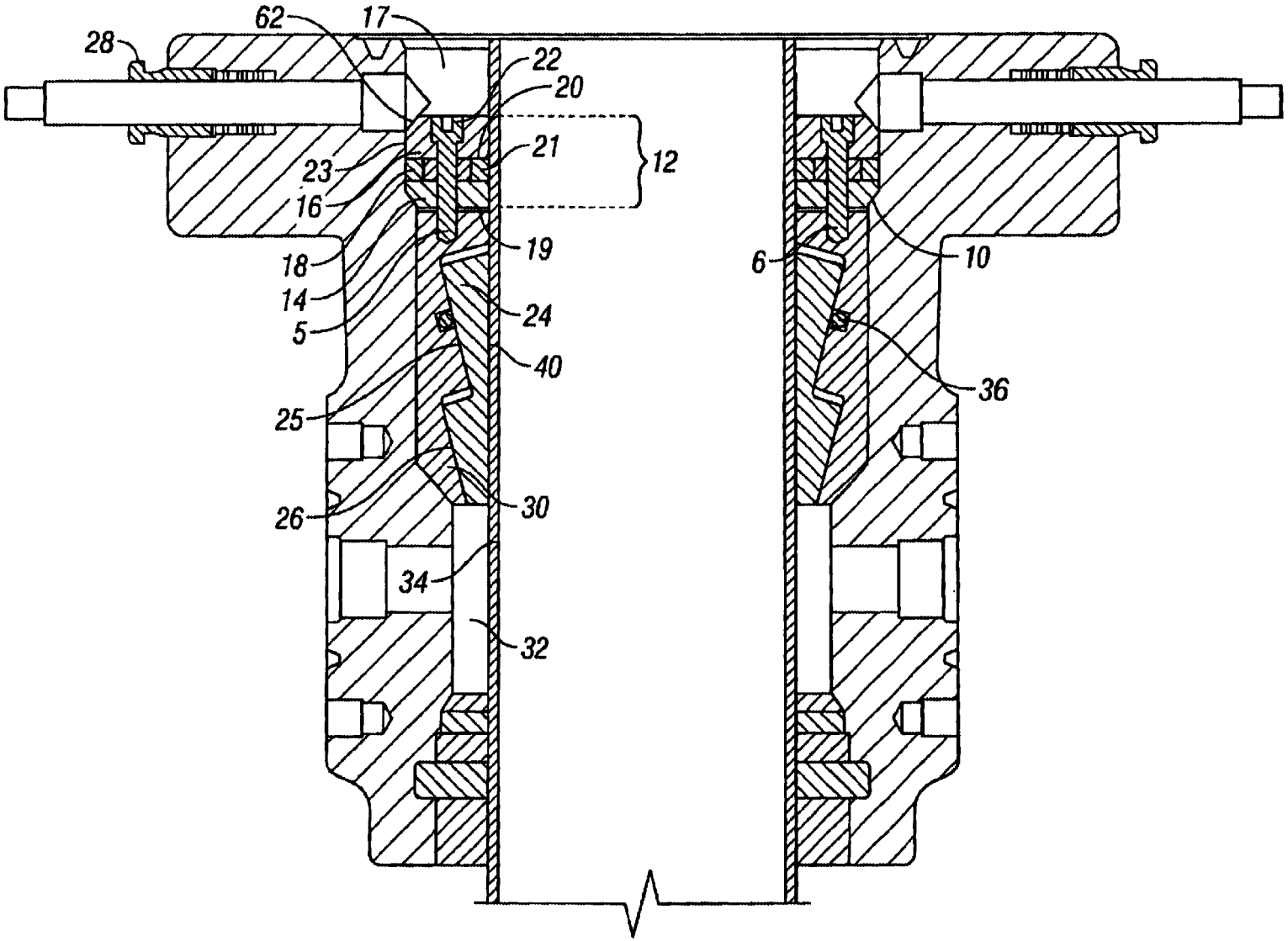
FIG. 1 is a cross section of the invention.

FIG. 1 shows a slip type-casing hanger having the additional inventive adjustable isolation plate 12 secured thereto.

The isolation plate 12, further comprises an upper plate 16 and a lower plate 14. The upper plate 16 adjoins the annulus 17. The lower plate 14 is landed on the load shoulder 10. A space 19 provides adjustment space between lower plate 14 and hanger body 30. The upper and lower plates each have a thickness between ½ and 2 inches. The isolation plate is integral to the hanger body. The isolation plate provides a high pressure seal between the casing string and the annulus.

A spacer 20 is disposed between the upper plate 16 and lower plate 14. The spacer is preferable a split ring spacer and has a thickness from between ½ and 1 inch between the upper plate 16 and lower plate 14. Pluralities of fasteners, such as bolts are used to secure the spacers between the plates. Typically four bolts are contemplated as usable, but up to 12 can be used, or even more, depending on the size of the upper plate 16 and the tolerances needed for the casing hanger. Bolt 5 and bolt 6 are shown passing through the spacer 20, which encompasses the annulus casing 34.

The spacer 20 is typically comprises a metal, such as steel, or another material such as a rigid phenolic compound which is capable of significant load bearing capacity. The spacer 20 enables weight load from the casing string to be transmitted to the load shoulder 10. Spacer 20 is also a positive stop for seal 18 and seal 21. The spacer facilitates control of compression of the seals preventing casing collapse by the seals, which can be elastomeric seals. This configuration has been shown to enable at least 30–35% more weight to be supported by the casing hanger than with known techniques.

A first seal 18, adjoins the outer bowl 23, and a second seal 21, adjoin the casing 34 are disposed around spacer 20. These two seals are disposed adjoining the inner side 64 and the outer side 66 of the spacer 20 as shown in more detail in FIG. 3. These two seals, first 18 and second seal 21 can be any thermoplastic material, rubber, synthetic rubber, butyl, nitrile or a similar strong material, which is capable of resisting degradation in a corrosive environment. Space 19 is maintained at a size that depends on the band of the tolerance of the casing 34. Space 19 can have a height from 0 inches to ½ inches in order to accommodate the band of tolerance from the casing 34.

Load shoulder 10 can have an angle for support between 0 and 45°, most preferably 45°. The load shoulder 10 is created from the inner portion of the upper bowl 23.

Optionally, a special isolation seal could be disposed on the surface of load shoulder 10 (not shown) to further assist in minimizing casing loads. This special isolation seal could be a metal to metal or an elastomeric seal.

The invention most preferably comprises two segments, each segment comprising a plurality of teeth 40 engage and suspend the casing 34. One slip segment 24 is shown in FIG. 1. Up to 12 segments are contemplated as usable within this invention, with each segment having a top step 25 and bottom step 26. Each top step 25 or bottom step 26 can have a load surface angle between 15 and 30 degrees. The slip segments engage the hanger body 30. In an alternative embodiment, each slip segment can have two top steps and two bottom steps. The top and bottom steps can be integral steps for each slip segment, or can be separate top and bottom steps, each step separately fabricated and independent of each other. If each slip segment comprises separate and independent top and bottom steps, the steps are slidably engaged with each other. Each slip segment can be between 2 and 8 inches long.

The slip segments are aligned by at least one alignment ring 36. This alignment ring can be one ring or a series of segmented rings to align the slip segments. The material that the alignment ring is constructed from can be steel, a phenolic material or a high strength plastic material and combinations thereof.

The isolation plate 12 provides the isolation seal for the annulus 32. Any conventional locking means, such as a locking screw 28 can be used within the scope of the invention to lock the isolation plate 12 forming a seal for the annulus 32. The locking means energize the adjustable isolation plate to seal the annulus.

Figure 2:
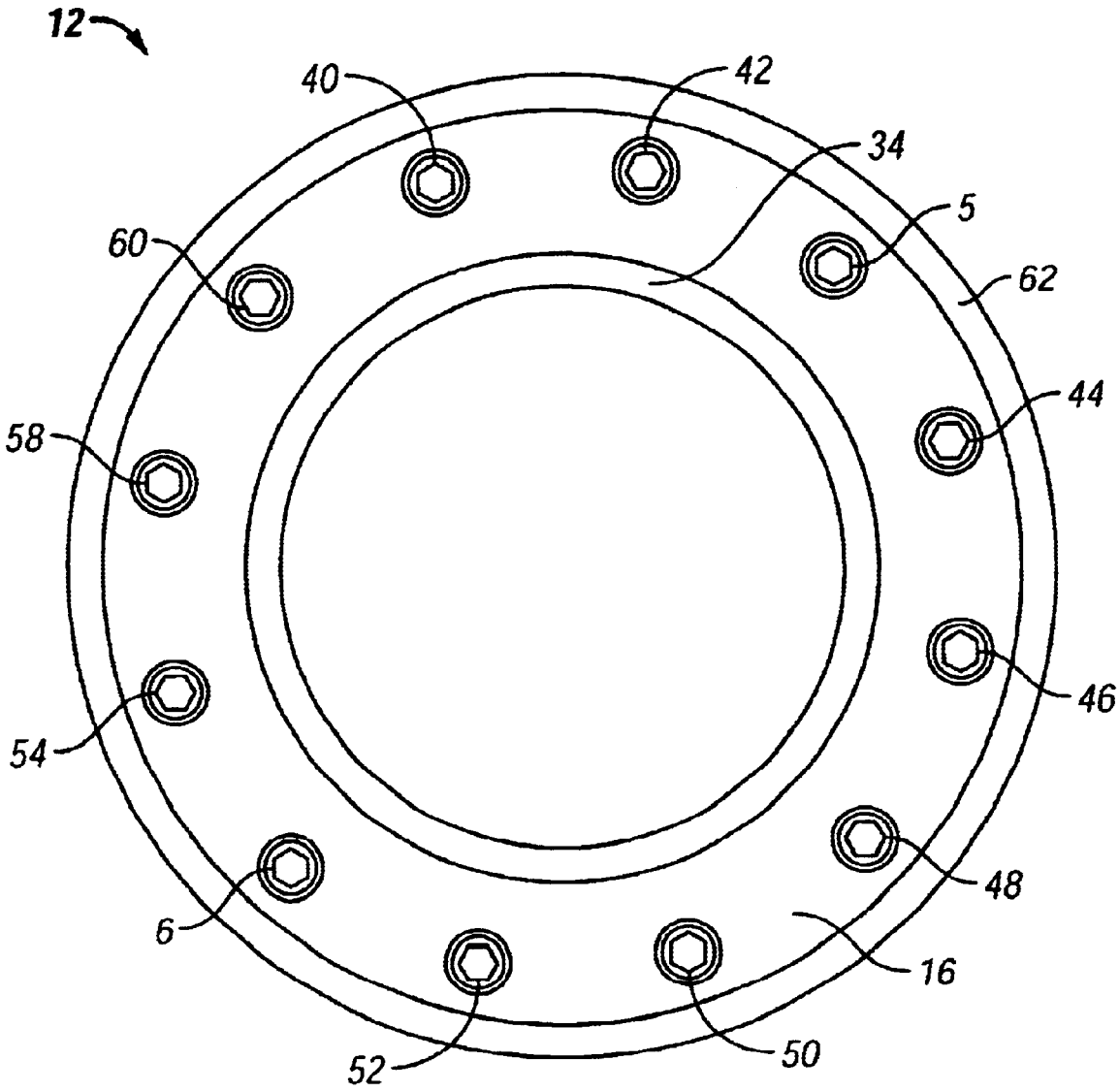
FIG. 2 is a top view of the isolation plate according to the invention.

FIG. 2 shows the isolation plate 12, which is disposed around the casing 34. The upper plate 16 is shown having 12 bolts disposed through the plate around the casing 34. The bolts are 40, 42, 5, 44, 46, 48, 50, 52, 6, 54, 58, and 60. Each bolt has a bolt head as shown in FIG. 1 as head 22. The bolts or fasteners energize the isolation plate for sealing the annulus.

FIG. 2 also shows plate 16 having a shoulder 62 for smoothly engaging the locking screw 28 (of FIG. 1). The most preferred angle for shoulder 62 is 45 degrees, but this angle can range between 0 and 45 degrees and still be usable.

Figure 3:
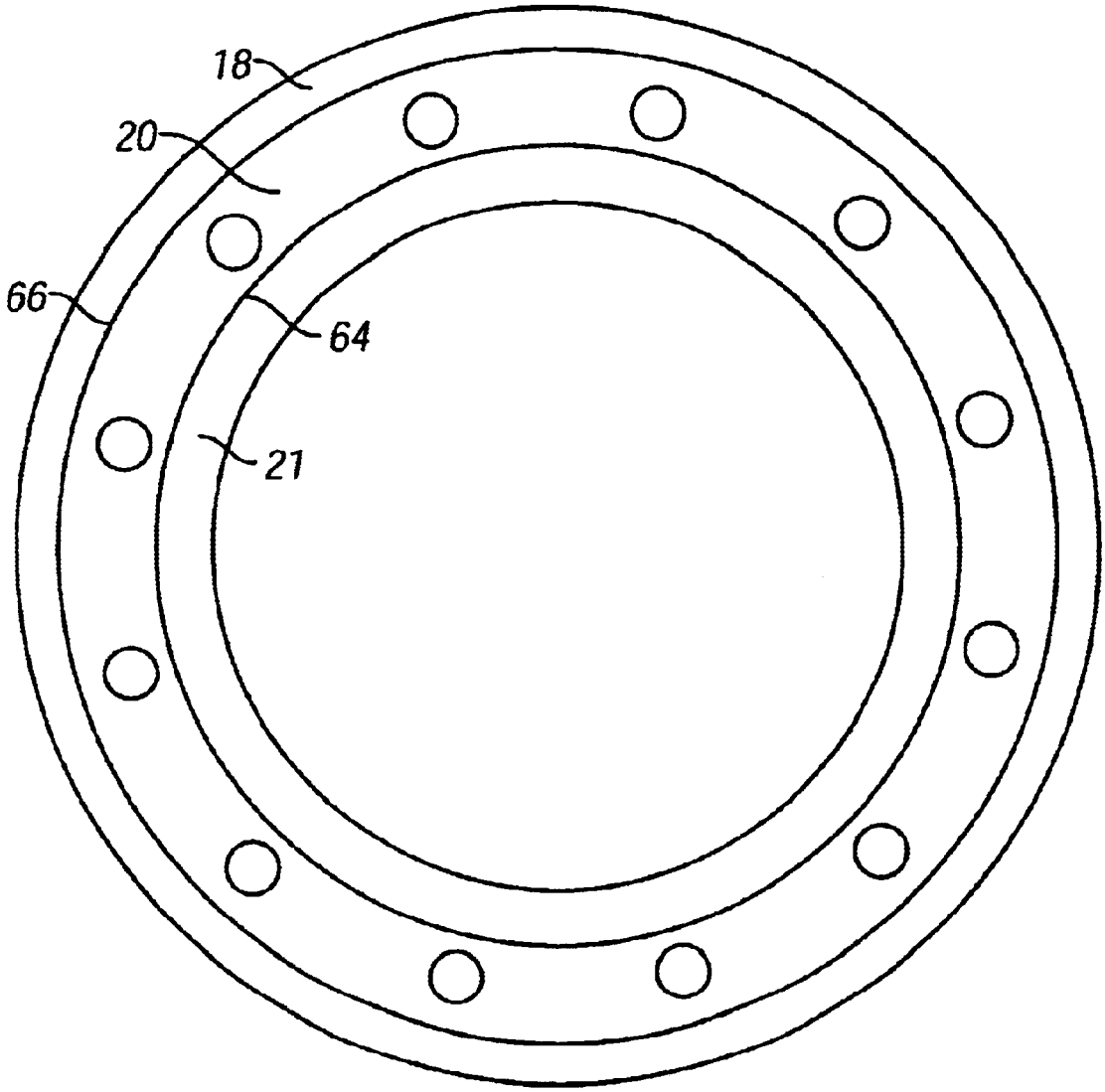
FIG. 3 is a top view of the spacer of the isolation plate.

FIG. 3 shows the spacer 20 having the first seal 18 and the second seal 21 disposed adjacent the spacer 20. Spacer 20 has an inner side 64 and an outer side 66.

From the foregoing, it will be seen that this invention is one well adapted to attain all of the objects set forth above, together with other advantages which are obvious and which are inherent to the method and apparatus.

It will be understood that certain features and sub combinations are of utility and may be employed without reference to other features and sub combinations. This is contemplated by and is within the scope of the claims.

Because many possible embodiments may be made of the invention without departing from the scope thereof, it is to be understood that all matters herein set forth or shown in the accompanying drawings is to be interpreted as illustrative and not in a limiting sense.

What is claimed is:

1. A slip type casing hanger assembly comprising:

a hanger body comprising an annulus and a casing head disposed around a casing, wherein the casing head is adapted for supporting and transferring weight of a casing string to said casing head and wherein the hanger body comprises:

an adjustable isolation plate for sealing the annulus, wherein the adjustable isolation plate comprises a lower plate landing on a load shoulder and an upper plate adjoining the annulus separated by a spacer bonded to at least two seals;

a plurality of fasteners for securing the spacer to the upper plate, the lower plate and the hanger body;

at least two slip segments, each comprising a plurality of teeth for engaging and suspending the casing string, a top step and a bottom step for engaging the hanger body;

at least one alignment ring for aligning the at least two slip segments; and locking means for securing the adjustable isolation plate against the load shoulder.

2. The slip type casing hanger of claim 1, wherein said spacer is a split ring spacer.

3. The slip type casing hanger of claim 2, wherein said spacer has a thickness from between ⅜ inch and 1 inch.

4. The slip type casing hanger assembly of claim 1, wherein said fasteners are bolts.

5. The slip type casing hanger assembly of claim 1, wherein said fasteners are bolts, and said assembly uses between four and sixteen bolts.

6. The slip type casing hanger assembly of claim 4, wherein said bolts are metal.

7. The slip type casing hanger of claim 1, wherein each top step and each bottom step has an angle between 15 and 30 degrees from the vertical of said casing string.

8. The slip type casing hanger of claim 1, wherein said slip segments each comprises at least 2 top steps and at least 2 bottom steps.

9. The slip type casing hanger of claim 1, wherein said slips segments, each are between 6 and 8 inches long.

10. The slip type casing hanger of claim 1, wherein said load shoulder is angled between 0 and 45° from the vertical plane of the casing string.

11. The slip type casing hanger of claim 1, wherein said upper plate comprises a member of the group: a phenolic compound and a metal; and said lower plate comprises a metal.

12. The slip type casing hanger of claim 1 wherein said upper plate and said lower plate comprise a rigid metal.

13. The slip type casing hanger assembly of claim 1, wherein said upper and lower plates each have a thickness between ½ inch and 2 inches.

14. The slip type casing hanger of claim 1, wherein said upper plate is a perforated ring.

15. The slip type casing hanger of claim 1, wherein the locking means are a plurality of lock screws.

16. The slip type casing hanger of claim 1, wherein said slip segments comprise integral top and bottom steps.

17. The slip type casing hanger of claim 1, wherein said each slip segment comprises separate and independent top and bottom steps slidably engaged with each other.

18. The slip type casing hanger of claim 1, wherein the locking means energize the adjustable isolation plate to seal the annulus.

19. The slip type casing hanger of claim 1, wherein said fasteners energize the isolation plate for sealing the annulus.

* * * * *